US012252843B2

(12) United States Patent
Erlendsson

(10) Patent No.: US 12,252,843 B2
(45) Date of Patent: Mar. 18, 2025

(54) LONG LIVED SYNTHETIC ROPE FOR POWERED BLOCKS

(71) Applicant: HAMPIDJAN hf, Reykjavik (IS)

(72) Inventor: Hjortur Erlendsson, Kopavogur (IS)

(73) Assignee: HAMPIDJAN HF, Reykjavik (IS)

( * ) Notice: Subject to any disclaimer, the term of this patent is extended or adjusted under 35 U.S.C. 154(b) by 0 days.

(21) Appl. No.: 17/569,506

(22) Filed: Jan. 6, 2022

(65) Prior Publication Data

US 2023/0332351 A1 Oct. 19, 2023

Related U.S. Application Data

(63) Continuation of application No. 16/302,672, filed as application No. PCT/IS2017/050007 on May 17, 2017, now abandoned.

(60) Provisional application No. 62/337,820, filed on May 17, 2016.

(51) Int. Cl.

| | |
|---|---|
| ***D07B 1/04*** | (2006.01) |
| ***D07B 1/02*** | (2006.01) |
| ***D07B 1/16*** | (2006.01) |
| ***D07B 5/00*** | (2006.01) |
| ***D07B 5/12*** | (2006.01) |

(52) U.S. Cl.

CPC ..... *D07B 1/04* (2013.01); *D07B 1/025* (2013.01); *D07B 1/16* (2013.01); *D07B 1/162* (2013.01); *D07B 1/165* (2013.01); *D07B 5/00* (2013.01); *D07B 5/12* (2013.01); *D07B 2201/1096* (2013.01); *D07B 2201/2049* (2013.01); *D07B 2201/2055* (2013.01); *D07B 2201/2066* (2013.01); *D07B 2201/2068* (2013.01); *D07B 2201/2089* (2013.01); *D07B 2201/209* (2013.01); *D07B 2205/2003* (2013.01); *D07B 2205/2014* (2013.01); *D07B 2205/205* (2013.01); *D07B 2205/2071* (2013.01); *D07B 2207/4054* (2013.01); *D07B 2401/205* (2013.01); *D07B 2501/2015* (2013.01); *D07B 2501/2038* (2013.01); *D07B 2501/2061* (2013.01)

(58) Field of Classification Search

None

See application file for complete search history.

(56) References Cited

U.S. PATENT DOCUMENTS

| | | | | |
|---|---|---|---|---|
| 4,022,010 A * | 5/1977 | Gladenbeck | ..... | D07B 1/025 57/232 |
| 2012/0160082 A1* | 6/2012 | Erlendsson | ..... | D07B 1/02 57/7 |

* cited by examiner

*Primary Examiner* — Jocelyn Bravo

(74) *Attorney, Agent, or Firm* — Tarolli, Sundheim, Covell & Tummino LLP

(57) ABSTRACT

Disclosed is a method for producing a high strength synthetic strength member containing rope and a resultant rope, comprising multiple layers of twisted and braided yarns, wherein individual sheaths enclosing individual strands are of a material such as HMPE, PTFE or UHMWPE with a lower decomposition temperature than the material of said strands being aramid, the method comprising subjecting parts of the rope to heat and tension thereby pre-stretching and creating a non-uniform or non-round shape of said strands, further choosing a combination of braid and twist angles as well as braid compressive forces to accommodate specific strength and elongation relation between the individual rope layers.

21 Claims, 2 Drawing Sheets

LONG LIVED SYNTHETIC ROPE FOR POWERED BLOCKS

TECHNICAL FIELD

The present disclosure relates generally to the technical field of synthetic ropes and, more particularly, to a rope that preferably is made from synthetic polymeric material, that has a rather high breaking strength and that also has a rather light weight compared to steel wire rope and that is capable of being used with powered blocks, traction winches, powered winches, powered drums, drum winches, powered capstans and in general any powered turning element and/or rotating element capable of applying force to a rope (hereinafter aggregately known as "powered blocks"). Such synthetic ropes include but are not limited to crane ropes, deep sea deployment and recovery ropes, tow ropes, towing warps, trawl warps (also known as "trawlwarps"), deep sea lowering and lifting ropes, powered block rigged mooring ropes, powered block rigged oil derrick anchoring ropes used with blocks and also with powered blocks, superwides and paravane lines used in seismic surveillance including but not limited to being used with towed arrays, yachting ropes, rigging ropes for pleasure craft including but not limited to sail craft, running rigging, powered block rigged anchor ropes, drag lines, and the like.

BACKGROUND ART

Due to the high costs of raw materials needed to produce synthetic high strength ropes such as ropes made from state of the art synthetic materials including UHMWPE and others, it is important to increase the both the longevity as well as the strength that can be obtained from synthetic high strength ropes for a given amount of material. In the case of increased longevity, the increase in longevity is important in order to reduce replacement costs. Additionally, the increase in longevity can permit use of lowered diameter and thus lighter and less expensive to deploy ropes as in the present state of the art larger than necessary initial diameters are selected in order to provide for a minimum desired longevity of the rope due to anticipated rates of decrease in rope strength and ultimate longevity. In the case of increased strength, the increase in strength is important both to decrease costs of raw materials and production process, costs of rigging equipment needed to carry, lift, stabilize and stably float and/or otherwise sustain and support the weight of the ropes, as well to decrease drag in water and drag in air of such ropes. In the environment of winches, drums and traction winches, i.e. powered blocks, it is especially important to make such ropes more readily usable on such powered blocks. Furthermore, it is important to increase the life expectancy of such ropes in order to obtain the greatest economic advantage from a given investment in any such rope.

In the present state of the art, when forming high strength synthetic strength members for use in forming a high strength rope, the strongest synthetic fiber available at a certain price point and suitable for a certain environment of intended deployment is used. It is well known that synthetic high strength ropes have a drawback of being very expensive. Furthermore, synthetic high strength ropes are prone to a much more rapid rate of degradation and experience failure sooner in comparison to steel wire ropes when used on powered blocks, whether in protected environments or in high temperature and abrasive environments, as opposed to when such synthetic high strength ropes are used in static applications.

Problematically, those high strength synthetic fibers that are lightest and most desirable for many applications requiring minimal weight due to the fact that they are relatively light in weight both in air and in water, such as UHMWPE, also are prone to creep. Conversely, high strength synthetic fibers that are the least prone to creep or that are considered to not creep, such as Aramids, are significantly heavier than UHMWPE. Numerous attempts at reducing the weight of high strength synthetic ropes while also eliminating the creep include combining Aramid fibers with UHMWPE fibers, and combining lyotropic and/or thermotropic polymer filaments with polyolefin filaments to form synthetic strength members of a combination of such filaments. Many publications and products with such filament combinations are known. The main idea is that, since the ultimate tensile strengths of Aramid and UHMWPE filaments are similar, and since UHMWPE filaments are significantly lighter than Aramids, that by combining these fiber types into a synthetic strength member that the weight of the strength member can be reduced in comparison to forming the strength member solely of Aramid filaments, while also eliminating the creep as when all fibers are fully loaded the Aramid fibers prevent the strength member from creeping.

However, while the issue of creep has largely been addressed by the known art, known high strength synthetic strength member ropes continue to experience a relatively high rate of degradation in applications where the rope experiences high heats in comparison to steel wire ropes, steel wire having a several fold greater decomposition temperature in comparison to even Aramid fibers. These applications can include high temperature applications, or can include applications where constant bending and/or bend fatigue results in high temperatures, especially in regions of the rope in contact with or near powered blocks and or non-powered sheaves.

Nonetheless, due to their relatively light weights and also due to their relative low diameters for a given strength, and also due to their ability to not rust or oxidize in air and humid environments at an appreciable rate compared to metal fibre ropes, state of the art high strength synthetic ropes, such as ropes made from Aramids (such as Technora®), UHMWPE and the like are highly desirable in many applications where light weights and minimal diameters are desired in order to minimize structural loads, especially in crane ropes and deep water mooring applications; in order to minimize the costs of structures to which the ropes affix; and also where low drags are desired such as in towed applications and mooring applications, the relatively low diameters of such synthetic high strength ropes providing for lowered drags compared to other synthetic ropes.

Due to the advantages of lightness of weight that high strength synthetic strength member ropes offer, attempts continue to be made to successfully deploy into industry on a wide scale high strength synthetic strength member ropes for use with powered blocks. However, the very high costs of such high strength synthetic strength member containing ropes compared to ropes having strength members formed of steel wire (i.e. "wire ropes), and the fact that such high strength synthetic strength member containing ropes when used with powered blocks experience rather fast deterioration when experiencing high temperatures in comparison to steel wire ropes, has resulted in the fact that today only limited market acceptance has been gained for high strength synthetic strength member containing ropes for use with powered blocks.

However, high strength synthetic strength member containing ropes are also well known for being much safer for operators and crew than are wire ropes, for the reason that high strength synthetic strength member containing ropes do not store kinetic energy at an appreciable level in comparison to wire ropes, and thus during accidental severance do not generate the recoil that steel wire ropes are well known for, such recoil being responsible for many fatalities over the years.

WO 2004/020732 discloses a cable having a thermoplastic core within a braided synthetic strength member. The cable is a heat stretched cable exhibiting ultra-compactness and is useful for high tension powered block applications. In one embodiment, disclosed is a cable wherein the material of the thermoplastic core contacts both the synthetic strength member and a braided synthetic sheath formed about the outside of the strength member. However, this embodiment has failed to be widely commercially accepted for the reasons taught above, i.e. due to the fact that the strength of the cable is reduced by such construction. In all embodiments of this teaching, it is taught that the heat stretching and compacting of the cable is accomplished either by simultaneously heating and stretching with tension the combination of the strength member, the thermoplastic core and a second sheath formed about the thermoplastic core and also contained within the strength member, the purpose of such second sheath being to prevent uncontrolled flow of molten phase of the thermoplastic core during processing of the rope, or by first applying the heat and subsequently applying the tension.

WO 2011/027367, discloses a cable formed of three distinct synthetic substances, where the strength member is adhered to a braided sheath by a synthetic substance that differs from a synthetic substance forming both the sheath and the strength member, and also differs from another synthetic substance forming a core contained within the synthetic strength member, and where the elasticity of the synthetic substance adhering the synthetic strength member to the synthetic sheath is greater than the elasticity of any other of the synthetic substances forming the cable. This cable has found more commercial acceptance for use with high tension powered blocks in comparison to the cable taught in above referenced WO 2004/020732 and is a viable synthetic rope in the known art for use with high tension powered blocks such as trawler winches for purposes such as trawl warps, and this cable and its taught manufacturing processes represent both the state of the art as well as the trend in the Industry. However, when used in applications with powered blocks that require constant bending, such as over sheaves, those portions of this cable in contact with or proximal the powered block and/or a non-powered sheave, or those portions of this cable that are experiencing the constant bending, continue to experience failure at a faster rate in comparison to failure experienced by steel wire ropes in the same application, reducing the appeal of this rope and causing it to not be widely accepted into industry.

Due to the extremely high cost of high strength synthetic strength member containing ropes in comparison to steel wire ropes, and also due to their premature failure and short life spans when used with powered blocks in comparison to steel wire ropes, the adoption of high strength synthetic strength member ropes for use with powered blocks has been limited. For example, the majority of the world's trawlers even in highly developed regions continue to use steel wire rope as trawl warps, despite the great weight and safety concerns caused by such weight when the steel wire rope is stored on a trawl winch—i.e. vessel instability, it being well known that the weight of such stored wire trawling warps has often been implicated in vessel capsize.

Thus, it can be appreciated that a long felt need continues to exist in the industry for a high strength synthetic strength member containing rope that has a much longer life span in comparison to known high strength synthetic strength member containing ropes when used with powered blocks and/or sheaves so as to promote adoption into industry of these safer ropes for the benefit of operators and crew.

Definitions

Synonyms

The terms "fiber"; "fibre"; and "filament", in singular or in plural, are synonymous for purposes of the present disclosure.

Disclosure

It is an object of the present disclosure to provide for a high strength synthetic strength member containing rope for use with powered blocks that addresses the above stated long felt need in the industry.

It is an object of the present disclosure to provide for a high strength synthetic strength member containing rope capable of being used with powered blocks that has improved tolerance to constant bending over powered blocks and sheaves in comparison to known synthetic strength member containing ropes and thus exhibits improved strength retention over time in comparison to known synthetic strength member containing ropes.

It is another object of the present disclosure to provide for a high strength synthetic strength member containing rope capable of being used with powered blocks that exhibits improved strength.

It is yet another object of the present disclosure to provide for a high strength synthetic strength member containing rope capable of being used with powered blocks that exhibits both improved strength retention over time, and especially that has improved tolerance to constant bending over powered blocks and sheaves in comparison to known synthetic strength member containing ropes.

It is yet another object of the present disclosure to provide for a high strength synthetic strength member containing rope capable of being used with powered blocks and satisfying the above stated objects of the present disclosure where such rope is capable of being used in substitution of steel wire strength member containing ropes for applications including but not limited to trawl warps, anchoring lines, seismic lines, oil derrick anchoring and mooring lines, tow ropes, towing warps, deep sea deployment and recovery ropes, deep sea lowering and lifting ropes, powered block rigged mooring ropes, powered block rigged oil derrick anchoring ropes used with blocks and also with powered blocks, superwides and paravane lines used in seismic surveillance including but not limited to being used with towed arrays, yachting ropes, rigging ropes for pleasure craft including but not limited to sail craft, running rigging, powered block rigged anchor ropes, drag lines, climbing ropes, pulling lines and the like.

Disclosed is a method for producing a high strength synthetic strength member containing rope capable of being used with powered blocks, and the product resultant of such method, where such rope has lighter weight and similar or greater strength than steel wire strength member containing ropes used with powered blocks, and where also such rope has, in comparison to known synthetic strength member containing ropes, a longer service life and especially improved strength retention over time when used with powered blocks and and/or sheaves.

Description

Most broadly, the present disclosure is based upon the surprising and unexpected discovery that the tolerance to bend fatigue induced heat of a rope having a high strength synthetic strength member formed of fibers considered to be highly heat tolerant and especially Aramid fibers, can be increased by combining, in a certain fashion and construction not previously known, fibers that are lesser heat tolerant than are the Aramid fibers.

Broadly, the long lived synthetic rope for powered blocks of the present disclosure is based upon the surprising discovery that by forming a rope from multiple primary strands each formed of a combination of (i) Aramid fibers and (ii) other, significantly less heat tolerant fibers, where the Aramid fibers mainly form the body of the strand and the less heat tolerant fibers are concentrated at the outer regions of each strand, forming the strength member about a thermoplastic core and subjecting the strength member to heat-stretching and subsequent cooling under tension so as to permanently compact and permanently elongate the strength member, followed by enclosing the strength member within an outer sheath, that a high strength synthetic strength membered rope having a long service life and improved tolerance to bend fatigue induced high heats when used with powered blocks and/or sheaves is achieved.

Preferably, the rope thus formed has a longer service life when used with powered blocks and/or sheaves in comparison to known synthetic strength membered ropes The long-lived synthetic rope for powered blocks of the present disclosure includes: a first synthetic substance, that preferably forms a core that is located internal the rope's strength member; a synthetic strength member formed with a hollow braided construction about the core and formed of a plurality of individual primary strands (that themselves can be formed of yarns other substrands) where each of the individual primary strands is formed of a second synthetic substance; a third synthetic substance forming a plurality of individual primary strand sheaths where at least some and preferably all of the individual primary strands are each enclosed by preferably one of the individual primary strand sheaths formed of the third synthetic substance; and, a final outer sheath enclosing the strength member formed of the primary strands that are preferably each enclosed within an primary strand sheath, where the second synthetic substance has a higher decomposition temperature than does the third synthetic substance, preferably at least one point seven to one point nine times more/greater; and has a higher rigidity than does the second synthetic substance, and where constrictive force applied by most and preferably by any primary strand sheath to the primary strand it encloses is lesser in comparison to constrictive force applied by the final outer sheath to the strength member.

Preferably, the constrictive force applied by most and preferably by any primary strand sheath to the primary strand it encloses is sufficiently low so that each of the primary strands is readily deformed during manufacturing of the rope and adopts a non-circular cross section in the finished rope product whereas the finished rope product itself adopts a cross section that is either circular or oval, or that appears to a casual observer with an unaided human eye to be either circular or oval, without regard to surface irregularities resultant of forming a braided sheath (e.g. without regard to the pits and valleys formed between braid weaves of braided sheath, though such are preferably filled by a fourth synthetic substance discussed below).

Preferably, but optionally, a fourth synthetic substance contacts the primary strand sheaths formed of the third synthetic substance and adheres the primary strand sheaths formed of the third synthetic substance to the final outer sheath enclosing the strength member that preferably is a braided sheath enclosing the hollow braided strength member, where the fourth synthetic substance is more elastic in comparison to all of the first, second, and third synthetic substances.

Preferably, the third synthetic substance is less brittle than is at least the second synthetic substance.

Preferably, a fifth synthetic substance forms a braided sheath about the thermoplastic core and such sheath is hollow braided about a thermoplastic rod prior to the strength member being hollow braided about the thermoplastic rod.

Most preferably, and vitally, the second synthetic substance has a higher decomposition temperature than does the third synthetic substance, and especially a decomposition temperature that is at least one hundred degrees C. greater than the decomposition temperature of the third synthetic substance and more preferably that is at least one hundred thirty degrees C. greater than the decomposition temperature of the third synthetic substance and yet more preferably that is about one hundred forty degrees C. greater or even more than is the decomposition temperature of the third synthetic substance. In some embodiments, it is preferred that the decomposition temperature of the second synthetic substance is at least three hundred degrees C. greater than is the decomposition temperature of the third synthetic substance, such as from three hundred fifty to three hundred seventy degrees C. greater.

Preferably, the third synthetic substance is used in forming a sheath enclosing each of the primary strands that are formed of the second synthetic substance and that form the hollow braided strength member. In one embodiment of the present disclosure, the third synthetic substance is extruded and/or pultruded over a primary strand to form the primary strand sheath. In another embodiment of the present disclosure, the third synthetic substance is formed as a tape. Then, each of the individual primary strands formed of the second synthetic substance and that are intended to be the main strands forming the rope's strength member are wrapped with this tape. Preferably the tape formed of the third synthetic substance is wrapped about individual primary strands in such as fashion as to have the tape's edges overlap one another, such as with a fifty percent overlap. The extent of the overlapping is such that after stretching steps taught herein the tape continues to cover all of the exterior of any distinct primary strand about which the tape is used to form a distinct primary strand sheath. The wrapped strands are then used to form the hollow braided strength member in such a fashion that individual primary strand sheaths formed of the third synthetic substance contact one another after the primary strands are braided together to form the hollow braided strength member. In other terms, the wrapped primary strands are then used to form the hollow braided strength member in such a fashion that the construction of the hollow braided strength member has several braided primary strands formed of the second synthetic substance, where several and preferably all of the primary strands formed of the second synthetic substance are each individually enclosed within a sheath formed of the third synthetic substance, where in the finished hollow braided strength member various of the individual primary strand sheaths formed of the third synthetic substance contact one another. In another embodiment that is a presently most preferred embodiment, the third synthetic substance is used to form other strands, or fibers or filaments, that are used to form braided sheaths about the primary strands formed of the second synthetic substance so as to form braided primary strand sheaths rather than extruded and/or pultruded, or tape wrapped primary strand sheaths. In one embodiment, the third synthetic substance is use to form flattened and/or tape like strands, and these flattened and/or tape like strands formed of the third synthetic substance are not twisted about their long axis and/or mainly are not twisted about their long axis when forming the braided primary strand sheaths about the individual strands formed of the second synthetic substance, or can be twisted about their long axis as they are used to form the braided primary strand sheaths, though being not twisted about their long axis when used to form the braided primary strand sheaths presently is preferred.

A presently preferred substance and structure for forming the second synthetic substance is a lyotropic polymer filament and/or a thermotropic polymer filament. Aramids are useful, such as Technora®. A newly developed fibre termed T200WD is presently preferred. Preferably, these fiber and/or filaments, formed of the second synthetic substance, are then further used to form yarns; the yarns are then further used to form strands; then these strands are further enclosed in sheaths formed of the third synthetic substance; and next these strands enclosed in such sheaths are then used in forming the hollow braided strength member.

A presently preferred substance for forming the third synthetic substance is Polytetrafluoroethylene (PTFE). UHMWPE also is considered useful, as is HMPE.

Most preferably, the method includes the additional step of, prior to enclosing the strands formed of the second synthetic substance within sheaths formed of the third synthetic substance, including about and between fibres forming the strength member a fourth synthetic substance where such fourth synthetic substance is capable of adhering one to another various fibres forming the strength member, such fourth synthetic substance having an elasticity that is lesser than the elasticity of the second synthetic substance.

An advantage of the disclosed synthetic rope for powered blocks is that it has greater tolerance to heat fatigue, that is caused by bending fatigue, than known synthetic ropes for powered blocks, thus reducing the long term costs to use the rope, thus promoting use of such ropes in environments where such ropes are known as being more safe for operators and crew, as discussed above.

Possessing the preceding advantages, the disclosed synthetic rope for powered blocks answers needs long felt in the industry.

It can readily be appreciated that these and other features, objects and advantages are able to be understood or apparent to those of ordinary skill in the art from the following detailed description of the preferred embodiment as illustrated in the various drawing FIGS.

BEST MODE FOR CARRYING OUT THE DISCLOSURE

Figure 1:
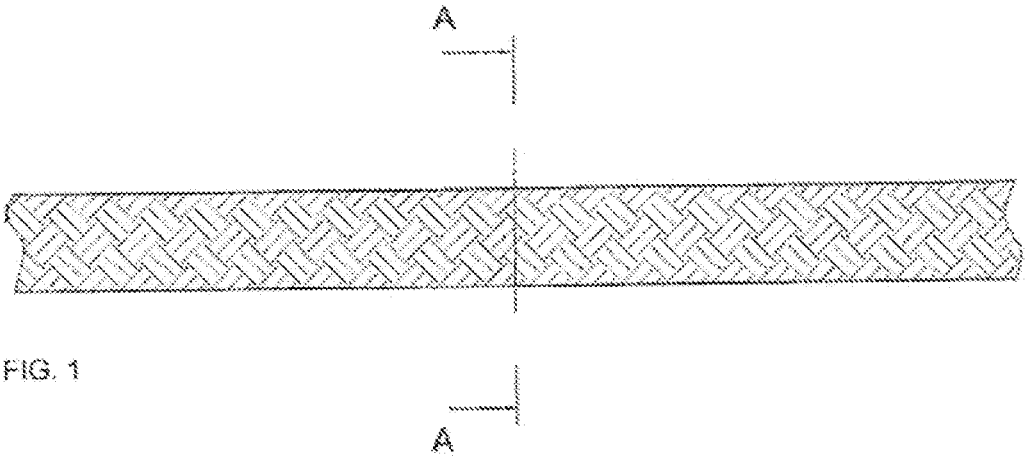
FIG. 1 is a plan view of a portion of a rope of the present disclosure.
Figure 2:
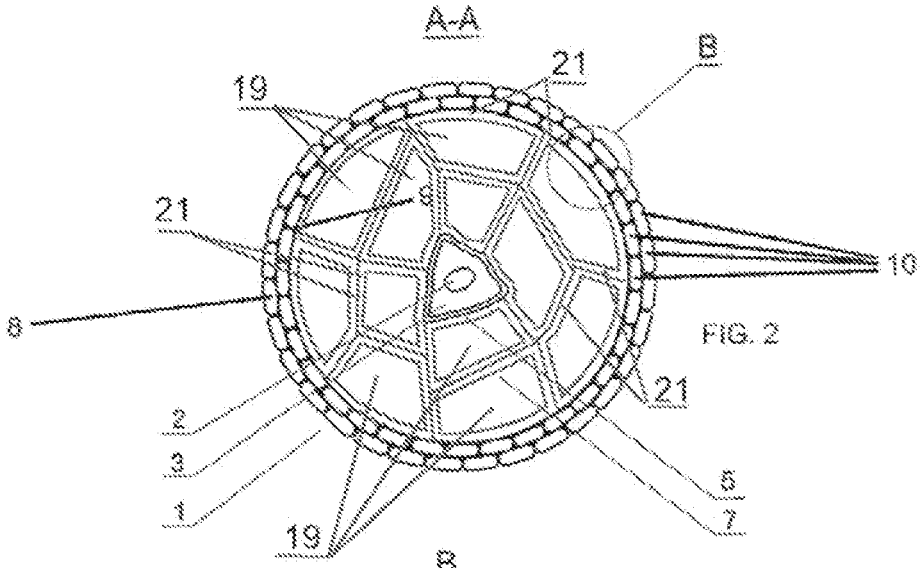
FIG. 2 is a view of a cross section of the Rope of the present disclosure taken along line A-A of FIG. 1.
Figure 3:
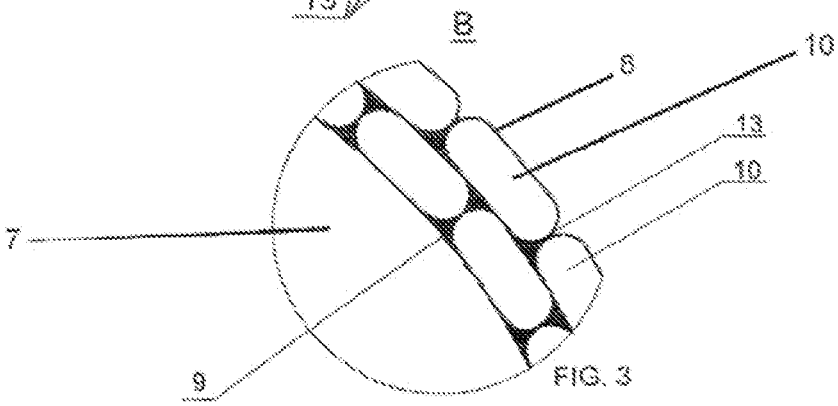
FIG. 3 is an expanded detail view of a portion of the cross section of the rope of the present disclosure shown in FIG. 2 that is indicated by reference character B. The expanded detailed view includes a braided outer sheath of the rope of the present disclosure, a portion of the strength member of the rope of the present disclosure where such portion of the strength member is proximal the braided outer sheath, as well as associated structures.
Figure 4:
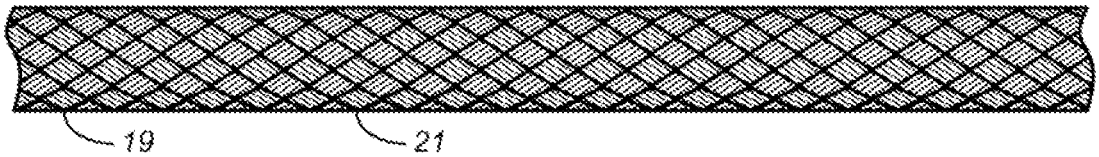
FIG. 4 is a plan view depicting an individual primary rope strand several of which form the strength member.
Figure 5:
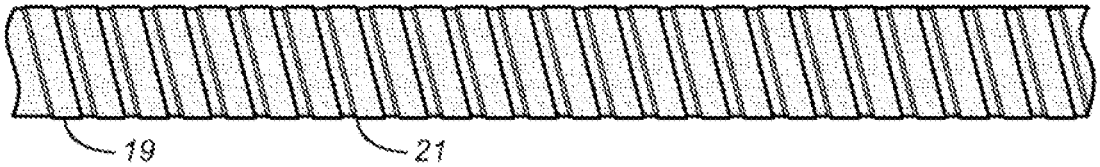
FIG. 5 is a plan view depicting an alternative embodiment of an individual primary rope strand several of which form the strength member.

FIG. 2 and FIG. 3 illustrate essential constructional components of one of the most preferred embodiments for use with high tension powered blocks of the long lived synthetic rope for powered blocks of the present disclosure that is identified by the general reference character 1. FIG. 2 depicts a preferably thermoplastic shaped supportive core 3 enclosing an optional core 2 that can be an elongatable conductive structure capable of transmitting information and/or data, or that can be a lead core, or other, the shaped supportive core 3 being enveloped within a flow shield sheath 5. Strength member 7 encloses the combination of the shaped supportive core 3, its enveloping flow shield sheath 5 and its optional core 2. The strength member is formed of several individual primary strands 19. The various individual primary strands 19 preferably are of uniform construction, or of similar construction. Each of the individual primary strands 19 is enclosed within a distinct primary strand sheath 21. The individual primary strands 19 are each formed of fibres and/or filaments that are formed of the second synthetic substance, that preferably is an Aramid. Each of the distinct primary strand sheaths 21 are formed of the third synthetic substance, and preferably formed of either a wrapped tape of PTFE or a braided sheath formed of PTFE, HMPE or UHMWPE.

Exterior sheath 8 preferably is of a braided construction and is adhered to strength member 7 by elastic adhesive substance layer 9, that preferably is formed of a settable adhesive substance such as an adhesive polyurethane having a high elasticity and a high shear strength, such as a two or more component PUR. Preferably braided exterior sheath 8 is formed of multiple coverbraid strands 10 by use of a braiding machine, the coverbraid strands 10 preferably are of a laid construction. Preferably, there are thirty-two individual strands 10 forming the coverbraided exterior sheath 8, each strand 10 having between twenty-four to thirty-six UHMWPE or HMPE fibers in each strand, preferably of a abrasion resilient construction. However, any quantity of strands 10 forming the coverbraided exterior sheath 8 that provide sufficient wear resistance and strength transfer to the strength transfer to the strength member are useful, including but not limited to twenty-four, twenty-eight, thirty-six, forty-two, forty-eight, up to sixty-four and even much more. The braid tension on each strand 10 forming the coverbraided exterior sheath 8 during braiding operations is preferably about sixty-three kilogram, and can be from forty to one hundred sixty kilograms. Importantly, the braid tension on each strand forming a braided primary strand sheath 21 during braiding operations of any such braided primary strand sheath 21 when a braided sheath variant is selected for the primary strand sheaths 21 is lesser per strand forming a braided sheath 21 in comparison to the braid tension used per strand 10 during braiding operations when forming the coverbraided exterior sheath 8. The braid tension on each strand forming a braided primary strand sheath 21 during braiding operations of any such braided primary strand sheath 21 is preferably about seven kilograms, and can be from ten grams to thirty kilograms, though optionally it is nine times less than the braid tension used per strand 10 during braiding operations when forming the coverbraided exterior sheath 8, and is at least forty percent less.

Optionally, and preferably, as shown in more easily visible detail in FIG. 3, elastic adhesive substance gap filling surface layer 13 fills in depressions on the surface of rope 1 formed in between adjacent coverbraid strands 10. The core 2 is optional, and is preferred for deep sea deployment and retrieval applications, trawl warp applications and in the case of certain other applications, but not necessarily in the case of anchor lines and deep water oil derrick mooring and/or anchoring lines or yachting lines, although in some cases it may be used in such applications.

Shaped supportive core 3 also defines the first synthetic portion of the rope of the present disclosure mentioned above, and elastic adhesive substance layer 9 also defines the second synthetic portion of the rope of the present disclosure as mentioned above.

In order to form the rope of the present disclosure:

Preferred Fabrication Methods

There are two preferred embodiments of the present disclosure: one is a rope of the present disclosure for use in applications where the rope of the present disclosure is subject to storage under high compressive pressure, such as when used with high tension winches and drums, such as when used as a trawler's warp; another is where the rope of the present disclosure is not subject to storage under high compressive pressure, such as is common in many yachting applications.

In forming a preferred embodiment of the present disclosure for use in applications where the rope of the present disclosure is subject to storage under high compressive pressure:

First is provided a plurality of fibres and/or filaments formed of the second synthetic substance, that preferably is an Aramid, and preferably a new fibre known as T200WD. The fibres and/or filaments are used in forming several distinct primary strands 19. Preferably, twelve distinct primary strands 19 are formed. The primary strands 19 may be stranded directly from the fibres and/or filaments, or, first yarns may be formed and the yarns used to form the primary strands 19. The primary strands 19 may be braided, including loosely braided so as to provide noticeable constructional elongation, but twisted, and especially lightly twisted, as suitable for Aramids, and using known methods for forming strands formed of Aramids for use in forming a braided rope, is preferred.

Second, each of the distinct (the term "distinct" herein including "individual") primary strands 19 is enclosed within a distinct sheath 21, known also herein as a "primary strand sheath". Each distinct primary strand sheath 21 preferably is formed of a third synthetic substance having properties taught supra, and especially is formed of PTFE, but less preferably of HMPE or UHMWPE. The individual primary strand sheaths 21 may be formed by wrapping a tape formed of PTFE about each strand in such a fashion that edges of the tape overlap one another. The extent of the overlapping is such that after stretching steps taught herein the tape continues to cover all of the exterior of any distinct primary strand 19 about which the tape is used to form a distinct primary strand sheath 21. A fifty percent overlap is considered useful. However, it is presently preferred to form each of the distinct primary strand sheaths 21 as a braided sheath, where strands formed of PTFE may be used as strands to form each such braided primary strand sheath 21. Alternatively to PTFE, UHMWPE is also a suitable substance for the third synthetic substance, or tape like filaments of HMPE. When a braided sheath is selected for the individual primary sheaths 21, it is preferred to select to form the braided individual primary sheaths 21 with a braid angle that differs from the braid angle of any exterior sheath 8 that may be formed in subsequent steps as described herein and below. Most preferably, the braid angle selected for forming the braided individual primary sheaths 21 is a braid angle that is lesser than a braid angle selected for forming the exterior sheath 8, i.e. that is a "longer braid angle" or a "more acute" braid angle in comparison to a braid angle selected for forming the exterior sheath 8, the terms "longer braid angle" and "more acute braid angle" having the same meaning and being readily understood by those skilled in the art. The braid angle selected for the individual sheaths 21 may be similar (including "same") as the twist angle selected for forming primary strands 19 from fibers. That is, the same angle defined by fibers and/or filaments, or by yarns, forming primary strands 19, relative to the long axis of a straight (not bent) primary strand 19, can be selected as the braid angle for forming the individual sheaths 21 when it is selected to form the individual sheaths 21 with a braided construction, and preferably with a hollow braided construction, as described in more detail below Third, several, and preferably twelve of distinct primary strands 19 each enclosed within a distinct prima strand sheath 21.

Fourth, the primary strands 19 now enclosed within primary strand sheaths 21 are used to form a braided strength member having a hollow braided construction that is achieved by using a braiding machine to form the twelve (or other quantity) of primary strands 19 each enclosed within a distinct sheath 21 about a thermoplastic rod that forms the core 3, where the primary strands 19 are formed in a hollow braided construction about the thermoplastic rod forming the core 3. While twelve strands 19 are preferably preferred, it is possible to use from eight to forty-eight. Alternative to hollow braided, the strength member may be parallel laid, laid (including twisted) or plaited, but a hollow braided construction is preferred. It is highly preferably and important for a preferred embodiment of the instant disclosure that a hollow braided strength member is selected that has a thermoplastic core shaped so as to support the natural interior shape of the hollow braided strength member under tension approaching breaking strength of the strength member. Preferably, for a strength member is provided a braided strength member where the primary strands 19 forming the strength member have been stretched so as to remove constructional elongation and so as to cause compaction of the rope body, e.g. of the strength member and all contained within it, after the primary strands 19 have been braided into the strength member, so that the resultant strength member is unable to elongate greater than 5% before reaching break point when measured at an original tension of 1000 Kg, and preferably so that the resultant strength member is unable to elongate greater than 4% before reaching break point when measured at an original tension of 1000 Kg.

In forming a strength member for the preferred form of the instant disclosure the following further steps are employed:

First; a thermoplastic elongate object and especially a core formed of Polyethylene is provided, e.g. a PE rod, that ultimately forms core 3.

Second; a tightly woven braided flow-shield sheath 5 is braided around the thermoplastic rod. Filaments are selected to form the flow-shield sheath that are not made either liquid or semi-liquid at a temperature selected to change the phase of the thermoplastic rod, but rather that have a much higher softening point, and that are made of a synthetic substance unlike the synthetic substances of either the first, second, third or fourth synthetic substances, thus defining a fifth synthetic substance. Polyester is suitable.

Third; the primary strands 19 where each strand 19 is enclosed by a distinct primary strand sheath 21 are loaded onto bobbins that are loaded onto cars of a braided machine capable of forming hollow braids and are braided around the thermoplastic rod surrounded by a flow-shield sheath, so as to form a hollow braided strength member including a thermoplastic core surrounded by a flow-shield sheath.

Fourth; the braided strength member having the thermoplastic rod surrounded by the flow-shield sheath as its core is then subject to tension and to heat, preferably by being subject first to tension and secondly to heat, while maintaining the tension, in such a fashion and under such conditions that the thermoplastic selected to form the thermoplastic core becomes semi-liquid, i.e. molten, at a temperature that is used to permanently elongate the braided strength member by applying about thirteen percent of the cool strength member's breaking force to the heated strength member. The flow shield-sheath mainly or entirely stops the phase changed thermoplastic core from exiting the flow-shield sheath. That is, the majority of the thermoplastic core is unable to exit the flow-shield sheath even when the thermoplastic core is either liquid or semi-liquid, i.e. molten, despite enormous constrictive and compressive forces applied to the phase changed thermoplastic core as a result of the high tensions applied to the strength member, such high tensions able to permanently elongate the strength member under the conditions taught supra and herein.

A preferred tension to be used in the disclosed processes for forming the disclosed rope is about thirteen to fifteen percent (13-15%) of the break strength of the strength member when such break strength is measured at room temperature, with up to twenty-two percent being useful, and in some cases even more.

Importantly, the tension applied to the strength member, and thus necessarily also applied to the filaments forming the strength member, preferably is a static tension and/or a generally static tension and/or a very slowly fluctuating tension. After applying a predetermined tension (including approximately a predetermined tension), and while under such predetermined tension simultaneously the strength member, its filaments, and its thermoplastic core are heated to a predetermined temperature and/or to approximately a predetermined temperature as taught above and herein, with a minimum temperature of eighty (80) degrees C. being most preferred. The use of a long oven having many capstans able to accommodate a very long length of the strength member and turning at varying speeds and/or rates of rotation so as to maintain the tension on differing portions of the strength member located between different capstans, and thus by extension on the filaments forming the strength member as well as on the thermoplastic core also forming the strength member is highly useful, especially for permitting an endless flow production process.

Fifth; when the braided strength member and its thermoplastic core and the thermoplastic core's flow shield have been elongated to a predetermined amount so as to create an ultra-compact rope, and to experience a reduction in overall exterior diameter of the rope of thirty and up to forty-five percent in comparison to the rope's overall exterior diameter prior to the stretching and heat processing steps, the now elongated strength member and its elongated thermoplastic core are cooled while sufficient tension is maintained and applied to the strength member and thus by extension to its primary strands 19 and to its thermoplastic core 3 during the cooling process so that all such components are cooled to their respective solid states while under a tension that results in the cooled primary strands 19 as well as the cooled distinct primary strand sheaths 21 enclosing the primary strands 19, as well as the strength member and its thermoplastic core 3, having been permanently elongated so as to cause the strength member:

a) to acquire a lower elongation than it had prior to its having been permanently elongated;
b) to acquire a substantially lesser diameter and a greater compactness than it had prior to its having been permanently elongated;
c) to acquire to its thermoplastic content core a permanent solid shape, having at its surface the flow shield sheath also taking the same shape as the exterior of the core, that supports the interior cavity of the permanently elongated hollow braided strength member in such a fashion that the filaments and braid strands forming the strength member are sufficiently less able to move relative to one another in a direction perpendicular to the long dimension of the permanently elongated strength member in comparison to prior to the strength member having been permanently elongated so as to reduce filament to filament abrasive wear, and also so as to preclude crushing of the rope, especially under high compressive forces such as occurs during winding and storage on a high tension drum, the necessary tension to achieve such result for any particular filament type able to be experimentally determined by one of ordinary skill in the art after having read the present disclosure.

This cooling also is best accomplished and undertaken using capstans turning at varying speeds so as to maintain a tension on the elongated strength member and its components during the entire cooling process and period that precludes their shortening, so that the final cooled strength member has the values of elongation to break point as taught above and herein for a most preferred embodiment of the instant disclosure, and also the other properties taught as above and herein, as also is accomplishable in an endless flow production method.

Sixth; optionally, and preferably, an elastic adhesive substance, that is a fourth synthetic substance, is used to adhere the formed strength member to an exterior braided sheath 8. The fourth synthetic substance is chosen as a flowable settable adhesive substance. While it is in a liquid and/or semi-liquid (including "flowable") phase it is situated upon the outside surface of the preferably permanently elongated strength member, in contact with surfaces of multiple of the distinct primary strand sheaths 21 formed of the third synthetic substance. Then a preferably braided exterior sheath 8 is formed about the combination of the permanently elongated strength member and the flowable settable adhesive substance. The settable adhesive substance is situated upon the strength member at temperature that is lower than a phase change temperature of third synthetic substance. When a braided sheath is selected for the individual primary strand sheaths 21, it is preferred to select to form the braided individual primary strand sheaths 21 with a braid angle that differs from the braid angle of the exterior sheath 8. Most preferably, a braid angle selected for forming braided individual primary strand sheaths 21 is a braid angle that is lesser than a braid angle selected for forming the exterior sheath 8. The braid angle of the inner sheath 21 is an angle defined between (i) an imaginary line lying coaxial and parallel to the long axis of the primary strand 19 enclosed by the braided primary strand sheath 21 when the primary strand 19 is not curved or bent, but is straight; and (ii) a long dimension visible for any individual braid strand forming the braided construction of a primary strand sheath 21 when viewed in plan photographic view and when the primary strand 19 enclosed by the primary strand sheath 21 is straight (not bent). Similarly, the braid angle of the exterior sheath 8 is an angle defined between: (a) an imaginary line lying coaxial and parallel to the long axis of the rope when the rope is straight; and (b) a long dimension visible for any individual braid strand forming the braided construction of exterior sheath 8, when viewed in plan photographic view when the rope is straight.

Contrary to the state of the art, knowledge in the field and trend in the industry for forming braided sheaths, the braid angle selected for the individual sheaths 21 may, preferably, be similar (including "same") as the twist angle selected for forming primary strands 19 from fibers. That is, the same angle defined by fibers and/or filaments, or by yarns, forming primary strands 19, relative to the long axis of an straight primary strand 19, can be selected as the braid angle for forming the individual sheaths 21 when it is selected to form the individual sheaths 21 with a braided construction, and preferably with a hollow braided construction.

When selecting to form at least one and preferably all of the individual primary strand sheaths 21 with a braided construction; this process step is further, and most preferably, modified by additionally selecting a braid tension for forming at least one, and preferably all, of the braided individual sheaths 21 that is a braid tension that is lesser than a braid tension selected for forming the exterior sheath 8 about the final formed and final processed strength member that preferably has had the elastic adhesive substance situated exterior the itself, i.e. situated exterior the final processed form of the strength member, prior to the exterior sheath 8 being braided about the strength member.

INDUSTRIAL APPLICABILITY

Ropes formed by teachings of the present disclosure may be used as crane ropes, deep sea deployment and recovery ropes, tow ropes, towing warps, trawl warps (also known as "trawlwarps"), deep sea lowering and lifting ropes, powered block rigged mooring ropes, powered block rigged oil derrick anchoring ropes used with blocks and also with powered blocks, deep sea mooring ropes, deep sea winch lines, superwides and paravane lines used in seismic surveillance including but not limited to being used with towed arrays, yachting ropes, rigging ropes for pleasure craft including but not limited to sail craft, running rigging, powered block rigged anchor ropes, drag lines, and other.

Although the present disclosure has been described in terms of the presently preferred embodiment, it is to be understood that such disclosure is purely illustrative and is not to be interpreted as limiting. Consequently, without departing from the spirit and scope of the disclosure, various alterations, modifications and/or alternative applications of the disclosure are, no doubt, able to be understood by those ordinarily skilled in the art upon having read the preceding disclosure. Accordingly, it is intended that the following claims be interpreted as encompassing all alterations, modifications or alternative applications as fall within the true spirit and scope of the disclosure.

The invention claimed is:

1. A method for forming a synthetic rope (1), the method comprising steps of:

a) providing a core (3) formed of at least a first synthetic substance, wherein the first synthetic substance is a thermoplastic substance;

b) enclosing the core within at least a flow shield capable of retaining within the flow shield at least most of the first synthetic substance when the first synthetic substance is in a semi-liquid phase;

c) providing a plurality of individual primary strands (19) formed of fibers formed of at least a second synthetic substance, wherein the second synthetic substance is an Aramid;

d) forming from a third synthetic substance a plurality of inner individual sheaths (21), wherein each inner individual sheath (21) is formed as an individual braided sheath, wherein at least one inner individual sheath (21) formed as an individual braided sheath is formed about and encloses one of the individual primary stands (19) formed of the second synthetic substance, so that at least some of the individual primary strands (19) formed of the second synthetic substance are each enclosed by a respective one of the inner individual sheaths (21) formed of the third synthetic substance, wherein the third synthetic substance has a decomposition temperature that is lower than a decomposition temperature of the second synthetic substance;

e) next, forming a hollow braided strength member (7) around the core (3) from a plurality of the individual primary strands (19), wherein at least some of the individual primary strands (19) used in forming the hollow braided strength member (7) have at least one inner individual sheath (21);

f) subjecting the strength member to tension and heat so as to cause the core to experience a non-solid phase and so as to cause the strength member and the core to become compacted and elongated; followed by cooling both at least the strength member and the core under tension so as to cause the strength member and the core to become permanently compacted and permanently elongated; and g) enclosing the strength member within an outer sheath (8), wherein the synthetic rope is permanently compacted and permanently elongated.

2. The method of claim 1 wherein the third synthetic substance is less bristle than the second synthetic substance.

3. The method of claim 2 further comprising stranding the primary strands (19) directly from fibers and/or filaments.

4. The method of claim 1 wherein at least one inner individual sheath (21) formed as an individual braided sheath is formed from fibers.

5. The method of claim 4 wherein the fibers forming each fiber-formed inner individual braided sheath (21) are HMPE fibers.

6. The method of claim 5 further comprising the step of forming the outer sheath (8) with a hollow braided construction, and by adhering the hollow braided strength member (7) to the hollow braided outer sheath (8) by steps of:

h) situating at least a fourth synthetic substance in a flowable phase onto an exterior surface of a plurality of the inner individual braided sheaths (21) formed of the third synthetic substance, wherein said fourth synthetic substance is, when in a set and/or solid state, an elastic and adhesive substance; and i) followed by forming a hollow braided outer sheath (8) about the hollow braided strength member (7), wherein the hollow braided outer sheath (8) compresses against the exterior surfaces of at least portions of the plurality of the inner individual braided sheaths (21) formed of the third synthetic substance.

7. The method of claim 6 further comprising applying a constrictive force by a plurality of the inner individual braided sheaths (21) to a plurality of the primary strands (19) that is a constrictive force that is sufficiently low so that a plurality the primary strands (19) are deformed during manufacturing of the rope and adopt a non-circular cross section in a finished product of the rope when viewed in a plane that is perpendicular to the long dimension of the rope.

8. The method of claim 7 further comprising forming a plurality of the inner individual braided sheaths (21) from flattened fibers.

9. The method of claim 8 further comprising braiding the sheaths (21) from the flattened fibers in such fashion that at least some of the flattened fibers are untwisted about their long axis along a section of the finished product of the rope.

10. The method of claim 9 further comprising stranding the primary strands (19) directly from fibers and/or filaments.

11. The method claim 8 further comprising stranding the primary strands (19) directly from fibers and/or filaments.

12. The method of claim 7 further comprising stranding the primary strands (19) directly from fibers and/or filaments.

13. The method of claim 4 wherein the fibers forming each fiber-formed inner individual braided sheath (21) are PTFE fibers.

14. The method of claim 13 further comprising the step of forming the outer sheath (8) with a hollow braided construction, and by adhering the hollow braided strength member (7) to the hollow braided outer sheath (8) by steps of:

h) situating at least a fourth synthetic substance in a flowable phase onto an exterior surface of a plurality of the inner individual braided sheaths (21) formed of the third synthetic substance, wherein said fourth synthetic substance is, when in a set and/or solid state, an elastic and adhesive substance; and followed by forming a hollow braided outer sheath (8) about the hollow braided strength member (7), and wherein the hollow braided outer sheath compresses against the exterior surfaces of at least portions of a plurality of the inner individual braided sheaths (21) of the third synthetic substance.

15. The method of claim 14 further comprising applying a constrictive force by a plurality of the inner individual braided sheaths (21) to a plurality of the primary strands (19) that is a constrictive force that is sufficiently low so that a plurality of the primary strands (19) are deformed during manufacturing of the rope and adopt a non-circular cross section in a finished product of the rope when viewed in a plane that is perpendicular to the long dimension of the rope.

16. The method of 15 further comprising stranding the primary strands (19) directly from fibers and/or filaments.

17. The method of claim 15 further comprising forming a plurality of the inner individual braided sheaths (21) from flattened fiber.

18. The method of claim 17 further comprising braiding the sheaths (21) from the flattened fibers in such fashion that at least some of the flattened fibers are untwisted about their long axis along a section of the finished product of the rope.

19. The method of claim 18 further comprising stranding the primary strands (19) directly from fibers and/or filaments.

20. The method of claim 17 further comprising stranding the primary strands (19) directly from fibers and/or filaments.

21. The method of claim 1 further comprising stranding the primary strands (19) directly from fibers and/or filaments.

* * * * *